US008739322B2

(12) United States Patent
Hof

(10) Patent No.: US 8,739,322 B2
(45) Date of Patent: Jun. 3, 2014

(54) FLOW CHANNEL IN WHICH WATER IS CAUSED TO FLOW BY MEANS OF A DELIVERY DEVICE DISPOSED IN A CIRCULATION LINE

(76) Inventor: Georg Hof, Purkersdorf (AT)

( * ) Notice: Subject to any disclaimer, the term of this patent is extended or adjusted under 35 U.S.C. 154(b) by 66 days.

(21) Appl. No.: 13/216,722

(22) Filed: Aug. 24, 2011

(65) Prior Publication Data

US 2012/0037248 A1 Feb. 16, 2012

Related U.S. Application Data

(63) Continuation of application No. PCT/AT2010/000048, filed on Feb. 23, 2010.

(30) Foreign Application Priority Data

Feb. 24, 2009 (AT) ..... GM98/2009 U

(51) Int. Cl.
*E04H 4/00* (2006.01)
*A61H 33/00* (2006.01)
*E04H 4/12* (2006.01)

(52) U.S. Cl.
CPC ..... *A61H 33/0087* (2013.01); *E04H 4/12* (2013.01); *Y10S 4/904* (2013.01)
USPC ..... 4/507; 4/488; 4/904

(58) Field of Classification Search
CPC ..... A61H 33/0087; E04H 4/12
USPC ..... 4/488, 492, 507, 509, 904
See application file for complete search history.

(56) References Cited

U.S. PATENT DOCUMENTS

| | | | | |
|---|---|---|---|---|
| 2,035,835 | A * | 3/1936 | Räber | 4/509 |
| 2,368,669 | A * | 2/1945 | Lee et al. | 203/1 |
| 4,903,352 | A * | 2/1990 | Murakami | 4/492 |
| 5,044,021 | A | 9/1991 | Murdock | |
| 8,141,180 | B2 * | 3/2012 | Hof | 4/488 |
| 2005/0170936 | A1 * | 8/2005 | Quinn | 482/55 |

FOREIGN PATENT DOCUMENTS

| | | | |
|---|---|---|---|
| EP | 1 808 554 | A2 | 7/2007 |
| WO | WO 01/12123 | A1 | 2/2001 |
| WO | WO 2006/076755 | A1 | 7/2006 |

* cited by examiner

*Primary Examiner* — Tuan N Nguyen
(74) *Attorney, Agent, or Firm* — Muncy, Geissler, Olds & Lowe, P.C.

(57) ABSTRACT

A flow duct is provided in which water is caused to flow by way of a delivery device disposed in a circulation line. In order to be able to adapt the flow inside the duct to the particular requirements, and/or achieve a laminar flow over the entire flow region, a plurality of circulation lines is provided, each having a controllable delivery device, wherein the circulation lines lead into the flow duct separately from each other, and wherein the discharge openings of the circulation lines are distributed over the face wall of the flow duct.

14 Claims, 9 Drawing Sheets v1 = 0
v = v2 = v3 > 0 vA = vB = vC = vD

FLOW CHANNEL IN WHICH WATER IS CAUSED TO FLOW BY MEANS OF A DELIVERY DEVICE DISPOSED IN A CIRCULATION LINE

This nonprovisional application is a continuation of International Application No. PCT/AT2010/000048, which was filed on Feb. 23, 2010, and which claims priority to Austrian Patent Application No. GM 98/2009, which was filed in Austria on Feb. 24, 2009, and which are both herein incorporated by reference.

BACKGROUND OF THE INVENTION

1. Field of the Invention

The invention relates to a flow channel in which water is caused to flow by means of a delivery device disposed in a circulation line.

2. Description of the Background Art

Highly diverse variations are prior in the art in this regard, whereby both turbine drives and jet propulsion are used in the circulation lines. In all known designs, however, different flow rates in the swimming zone occur, namely, in the horizontal and vertical direction. This is based on the fact that there are frictional resistances in the area of the walls and the bottom of the flow channel, whereby in addition turbulences also occur within the flows. Efforts have been made to correct these turbulences or different flows by deflection systems, egg crate grids, and stagnation pressure grids. These correction attempts do in fact improve the flow pattern, but different results are achieved at different flow velocities. To adjust these, said grids and deflection devices are made adjustable to match accordingly the flow velocities. This brings about turbulences because of the braking and deflection elements, which is not favorable for the flow pattern.

SUMMARY OF THE INVENTION

It is an object of the invention to provide a flow channel, in which uniform flow velocities can be achieved over the entire cross section of the channel, and/or the velocities are adjustable to the specific circumstances.

According to an embodiment of the invention, this object is attained in that a plurality of circulation lines each having a controllable delivery device is provided, whereby the circulation lines discharge separated from one another into the flow channel, and whereby the outlets of the circulation lines are distributed over the end wall of the flow channel. Thus, braking and deflection elements become unnecessary, as a result of which there is better utilization of the introduced energy. In addition, because of the individually controllable delivery device the flow velocity can be regulated in each of the circulation lines individually as needed.

Advantageously, the circulation lines can be divided into zones whose delivery devices are controlled differently. In this way, an increased resistance in the area of the walls or the bottom can be compensated by suitable control of the associated delivery devices. To this end, in the zones adjacent to the side walls and/or the bottom, the delivery devices can be adjusted to a higher flow velocity.

To standardize the flow further, the intake openings in the circulation lines can be disposed in the opposite end wall at the same height compared with the outlets in the flow channel. This achieves that the water can flow in a laminar manner in the flow channel. The design of the invention can therefore also be used as a parallel flow delivery device.

As an alternative to this, the intake openings of all circulation lines can also be disposed in the bottom area of the flow channel end opposite to the outlets, by which the water is drawn off via a uniform flow.

To achieve the most real-time regulation of the water flow possible, the delivery devices of all circulation lines can be regulated depending on the flow resistance in the associated circulation lines. To coordinate the delivery devices to one another, the delivery devices can be controlled via a common control unit. To this end, the control unit can be connected to sensors, measuring devices, or the like extending into the flow, whose measurement results are the control variables for the control unit.

Finally, a tube de-aerating device can be provided at each circulation line, for example, downstream of the delivery device, by which air entry, affecting the flow, in the flow channel is avoided.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
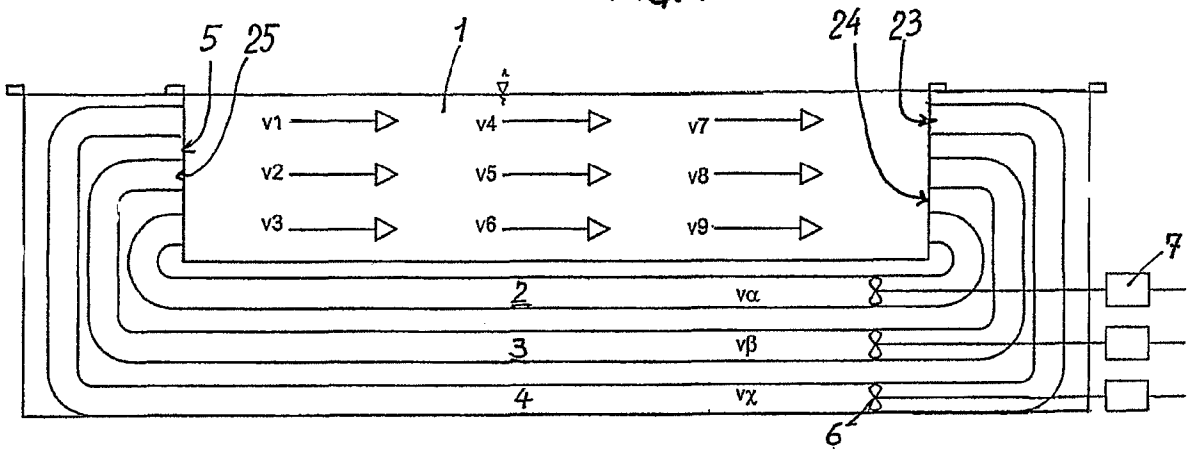
FIG. 1 shows the subject of the invention in a vertical longitudinal section.
Figure 3:
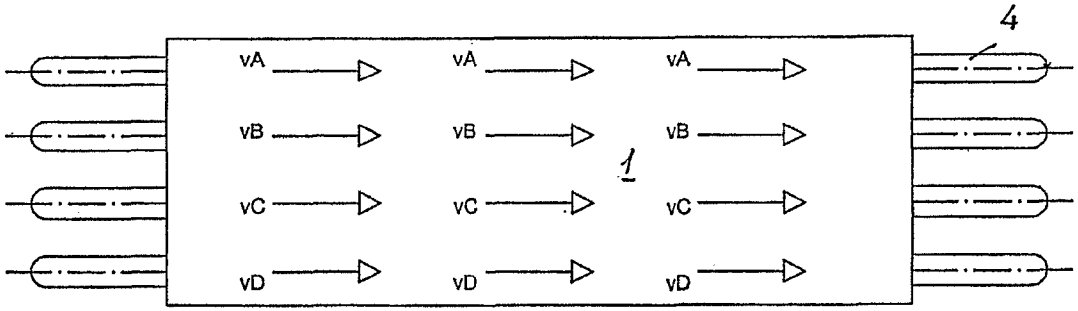
FIG. 3 shows a plan view of the flow channel.

In any of the appended drawings, the same reference characters are used throughout for the same parts in all figures.

Thus, the number 1 designates a flow channel, whose circulation lines 2, 3, 4 open out in front end wall 5. Delivery elements 6, driven by a motor 7, are disposed in each circulation line 2, 3, 4. The delivery elements in this case, as shown, can be disposed in the horizontal section of the circulation lines, whereby an arrangement in the vertical part of the circulation line is also possible, without the function being detrimentally affected. Further, as likewise not shown, the circulation lines can be returned running laterally from the pool.

Figure 2:
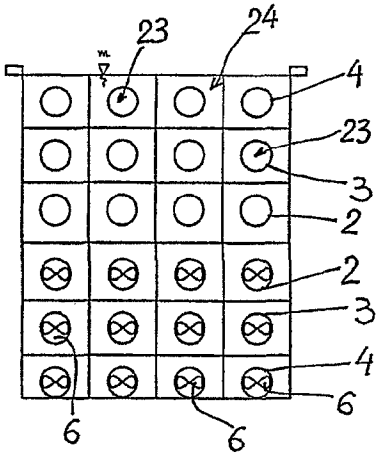
FIG. 2 shows it in a vertical cross section.
Figure 6:
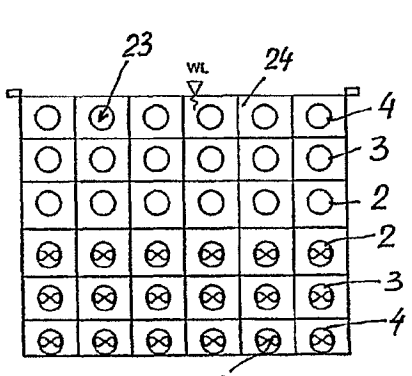
FIG. 6 shows a vertical cross section.
Figure 4:
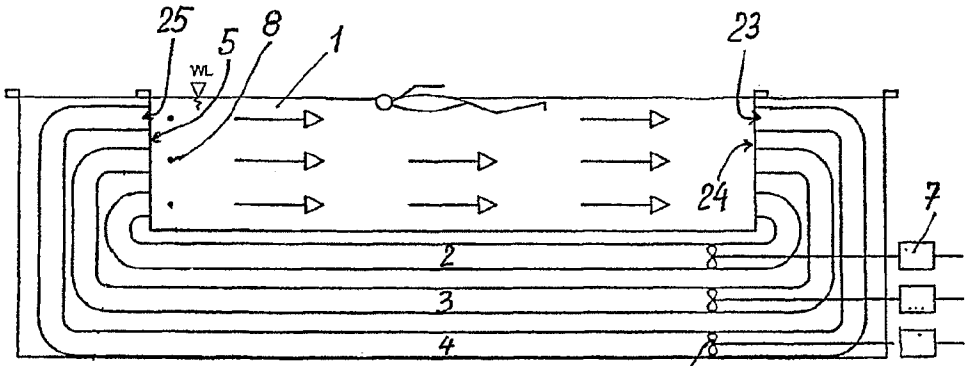
FIG. 4 again shows a vertical longitudinal cross section.
Figure 5:
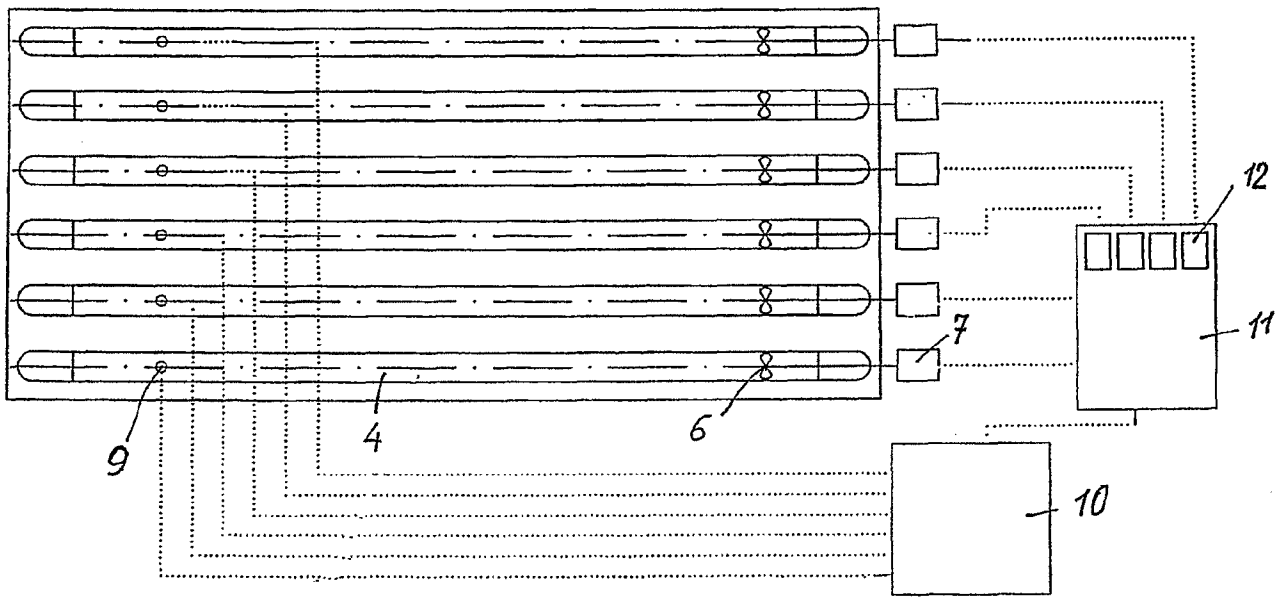
FIG. 5 shows a bottom view of the circulation lines with a schematic illustration of the control plan of the delivery devices.

The circulation lines 2, 3, 4 emerge from the back end wall 24, whereby the intake openings 23 thereof are disposed at the same height as outlets 25 of circulation lines 2, 3, 4 in front end wall 5. The flows achieved by means of individual circulation lines 2, 3, 4 in the flow channel are designated in the vertical direction by v1, v2, v3 in the first area, by v4, v5, v6 in the central area, and by v7, v8, v9 in the end area. In the horizontal direction, the flows are designated by vA, vB, vC, vD. To keep all flow velocities distributed in the flow channel at same value, the flow velocities vα, vβ, and vγ are controlled within the circulation lines via regulation of delivery devices 6. Furthermore, as shown in the cross-sectional view of FIG. 2, there are four circulation lines 4 that achieve the flow at the vertical direction v1 shown in FIG. 1, four circulation lines 3 that achieve the flow at the vertical direction v2 shown in FIG. 1 and four circulation lines 2 that achieve the flow at the vertical direction v3 shown in FIG. 1. As such, three groups of circulation lines 2, 3 and 4 are provided at differing heights from one another.

To regulate the flow velocity in flow channel 1, in the wall thereof flow measuring transducers 8 are provided, which pass on the results to a electronic control 10, which regulates drive motors 7 of delivery device 6 via a control panel 11 and controller 12. In addition, in the circulation lines flow meters 9 can be provided, which likewise pass the determined data to the electronic control 10. Depending on the value achieved via flow meter 8 and flow meter 9, the speed of the delivery device is set by the controller.

Figure 7:
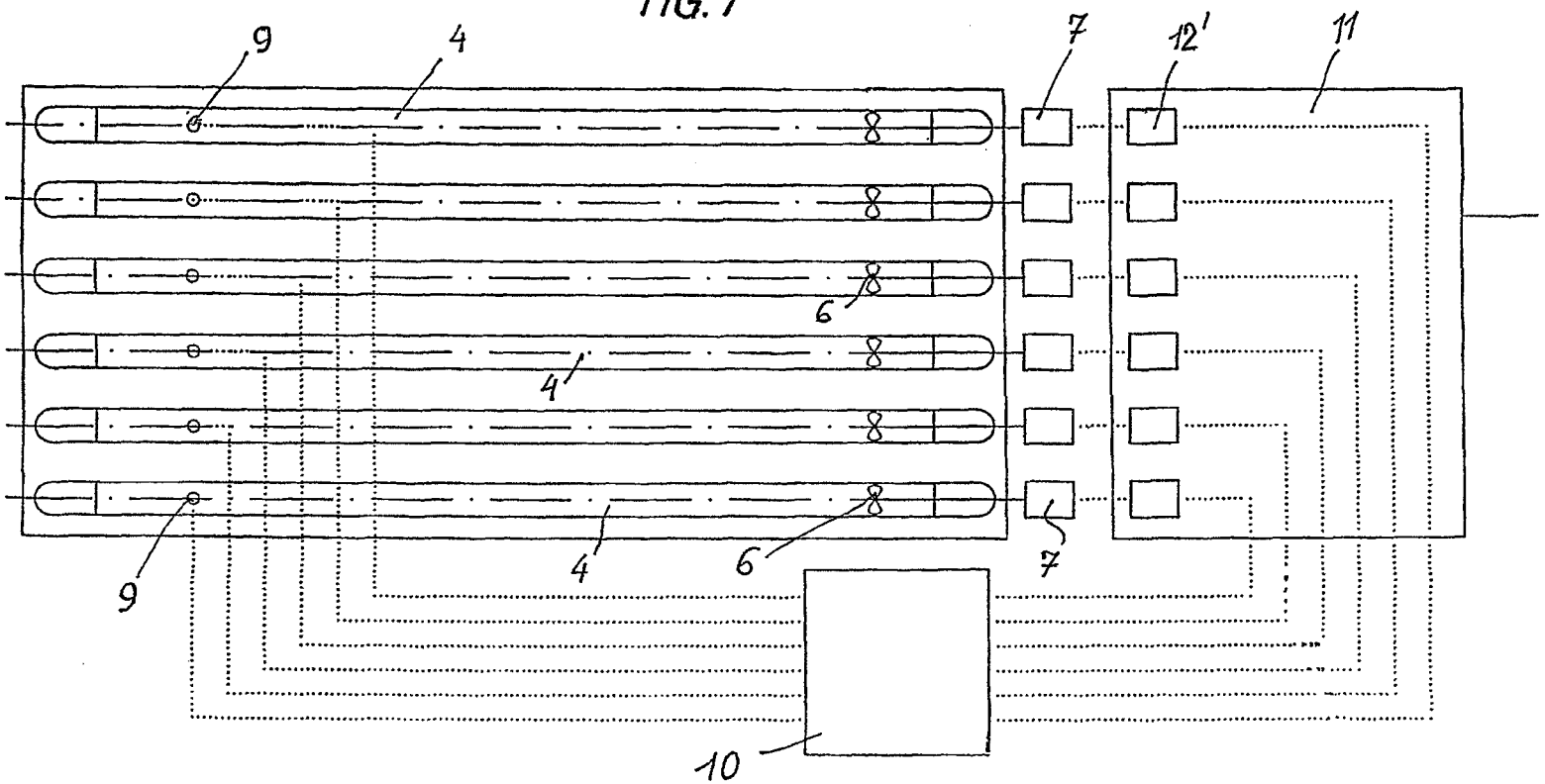
FIG. 7 shows a bottom view, analogous to FIG. 5, with a different control device.

In the embodiment shown in FIG. 7, the regulation of drive motors 7 of delivery device 6 occurs via the controller, which is designed as a frequency converter 12'. The regulation in this case occurs in the same manner as already described above.

Figure 8:
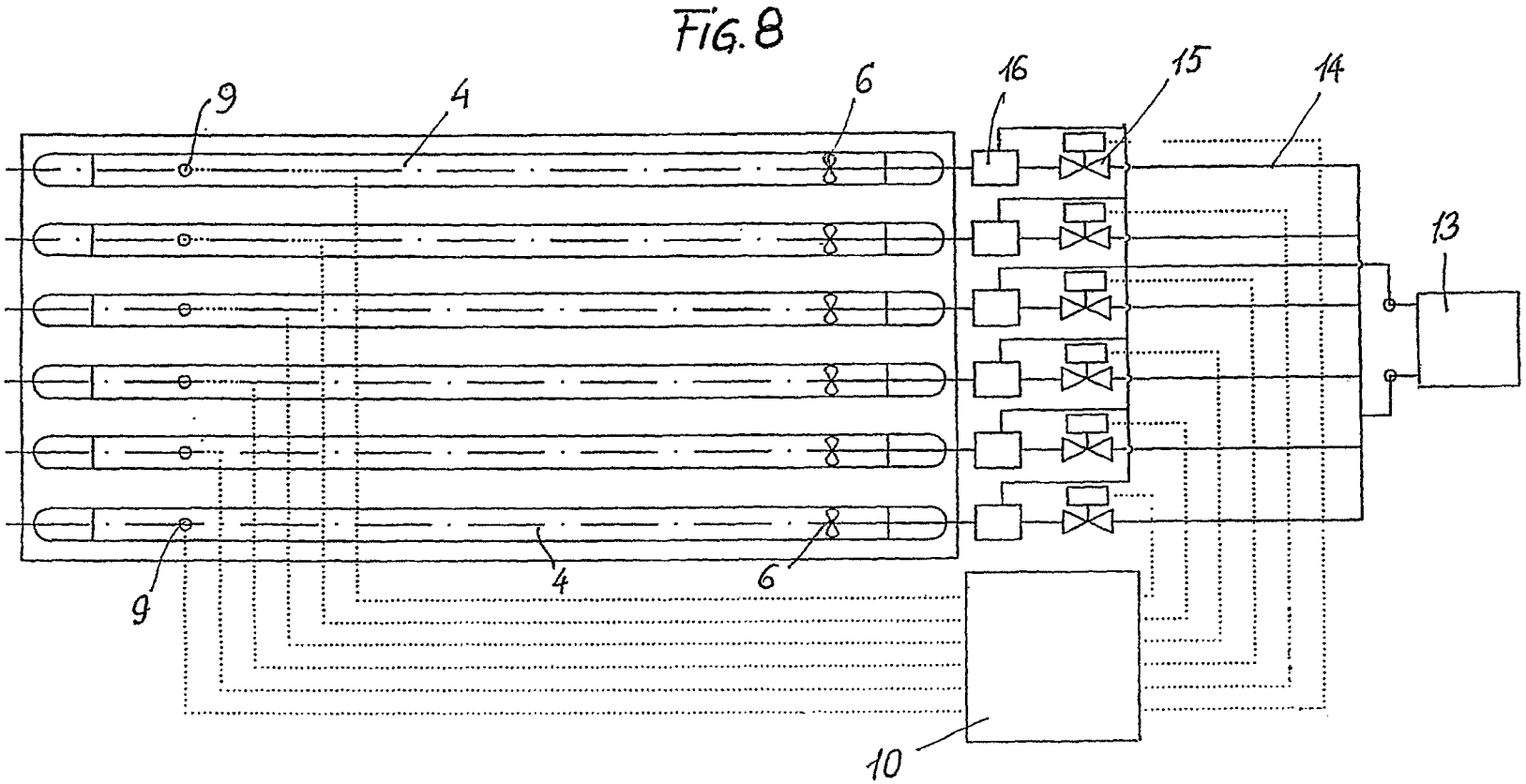
FIG. 8 again shows a bottom view according to FIG. 5, but with delivery devices driven by a hydraulic motor.

In the drive arrangement shown in FIG. 8, a hydraulic drive is provided for delivery device 6; namely, an oil pressure pump 13 is used for this purpose, which via oil pressure lines 14 controls control valves 15, which in turn then control the performance of an oil pressure turbine 16. Said oil pressure turbine is then connected via a drive shaft to delivery device 6 within the circulation lines. To regulate control valves 15, a control panel is again provided, which receives the measured data via flow meter 9 and optionally via flow meter 8 (not shown). Via said control panel then depending on the measurement results, control valves 15 are controlled and regulated via the control lines drawn as dotted lines.

Figure 9:
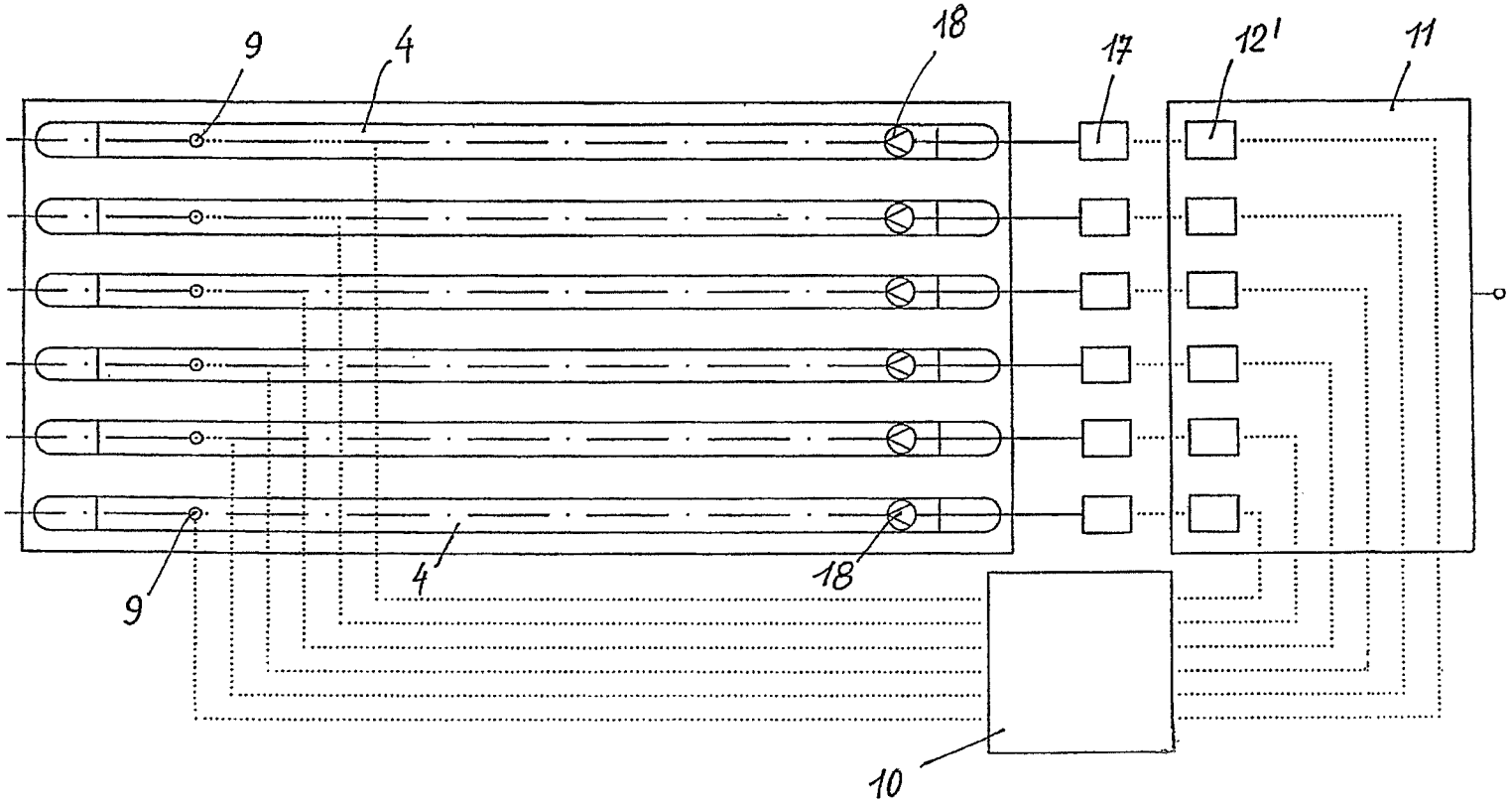
FIG. 9 shows a bottom view analogous to FIG. 5, in which oil pressure turbines are arranged.

In the embodiment variant according to FIG. 9, the delivery device within circulation lines 2, 3, and 4 is designed as a water jet pump 18, which is controlled via a corresponding drive motor 17. The control of said drive motor 17 again occurs via an electrical control panel 11, which is connected via control lines, on one side, with the flow meters 9 or flow meters 8 (not shown), disposed in circulation lines 2, 3, 4, in flow channel 1 to electronic control panel 12, in which frequency converters 12' are provided to control drive motors 17.

Figure 16:
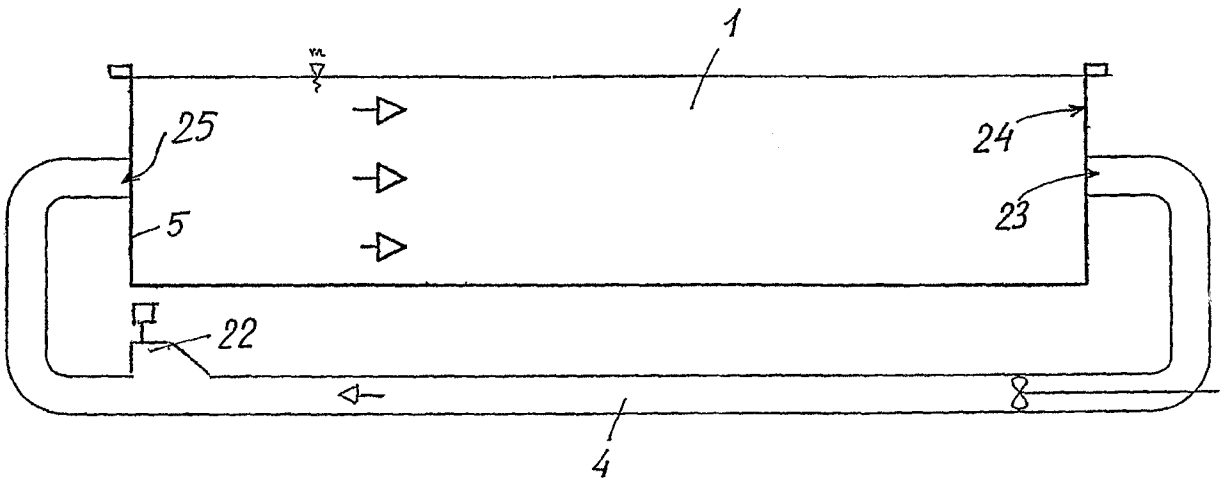
FIG. 16 shows a longitudinal cross section, whereby only one circulation line is drawn here in which a deaeration device is installed.

In addition, tube de-aerators 22 are provided in the circulation lines, in order to again separate the air, which is taken up by the water via the surface and flows in with the water via the circulation lines, from the circulated liquid (FIG. 16).

Figure 10:
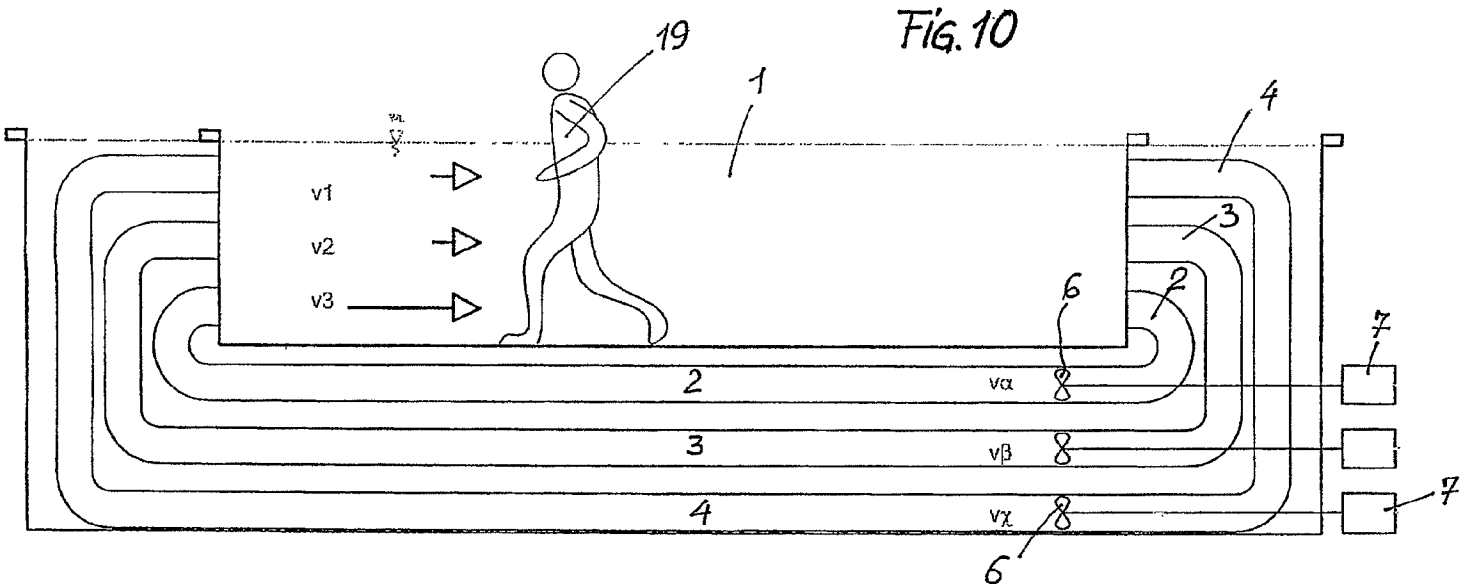
FIG. 10 shows a longitudinal cross section with a person training in the flow channel.
Figure 11:
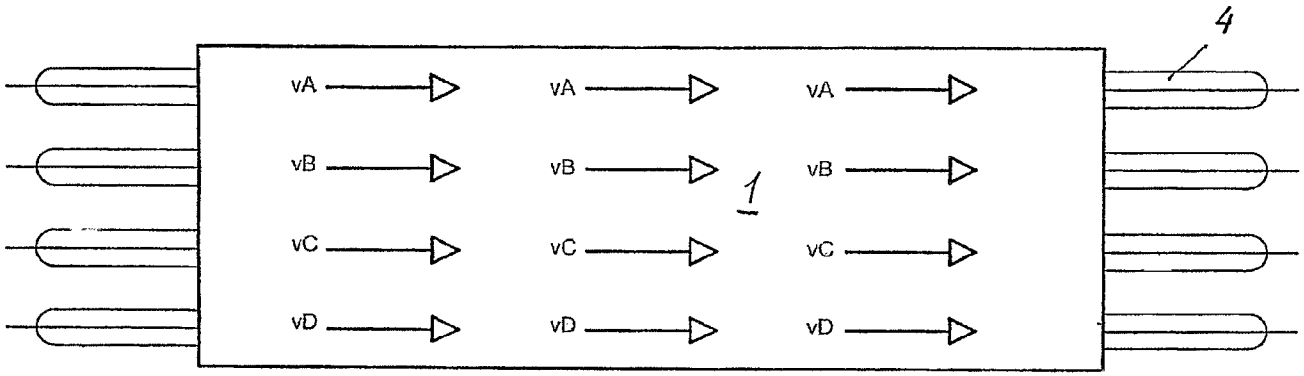
FIG. 11 shows a plan view of the flow channel with indicated flow.

In the exemplary embodiment shown in FIGS. 10 and 11, a training person 19 is shown in the flow channel, the person, who for therapeutic purposes, performs exercises or the like in the flow channel. For this therapy, a flow velocity is set greater than 0 only in the bottom area; i.e., v3 is greater than 0. v1 and v2 are equal to 0, whereby to move the legs the training person must only overcome a flow resistance or movement resistance. To this end, vα is set so that the flow velocity v3 has the desired value, but vβ and vγ are 0. The velocity is set uniformly across the horizontal extent of the flow channel (i.e., that all circulation lines located in the plane of the flow velocity v3 have a circulation velocity of vα), whereby optionally the circulation lines adjacent to the side walls of flow channel 1 have a slightly higher circulation velocity, so that the friction losses in the edge regions are compensated and a uniform laminar flow over the entire width of the flow channel is achieved.

Figure 12:
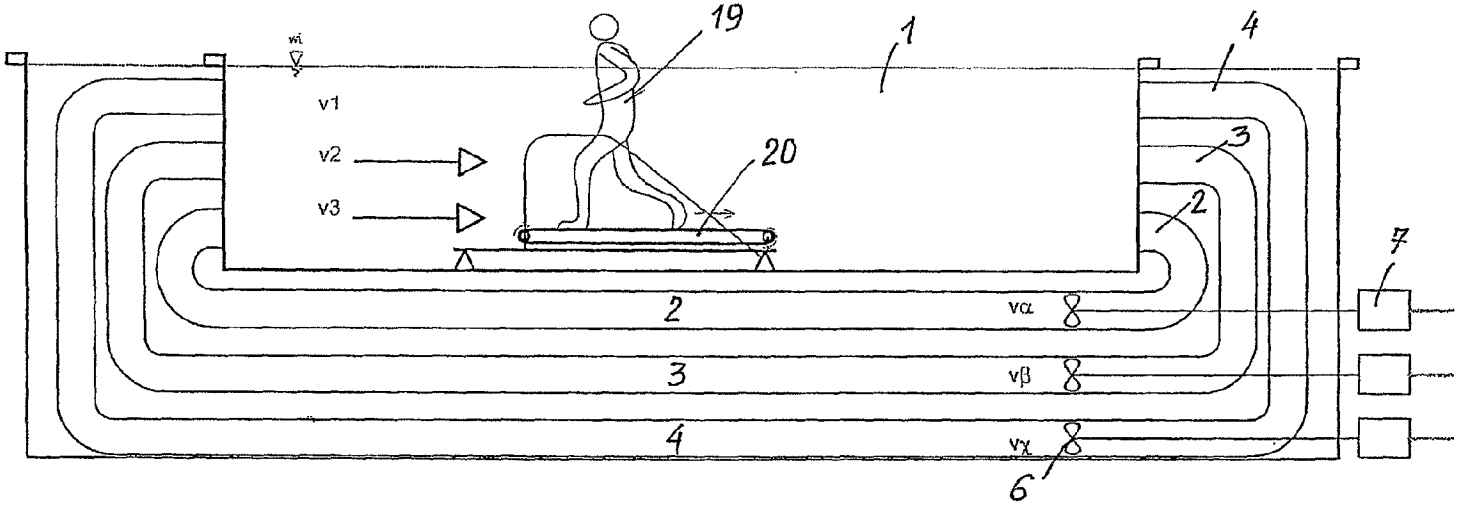
FIG. 12 is a side view analogous to FIG. 10 with an athlete on a treadmill.
Figure 13:
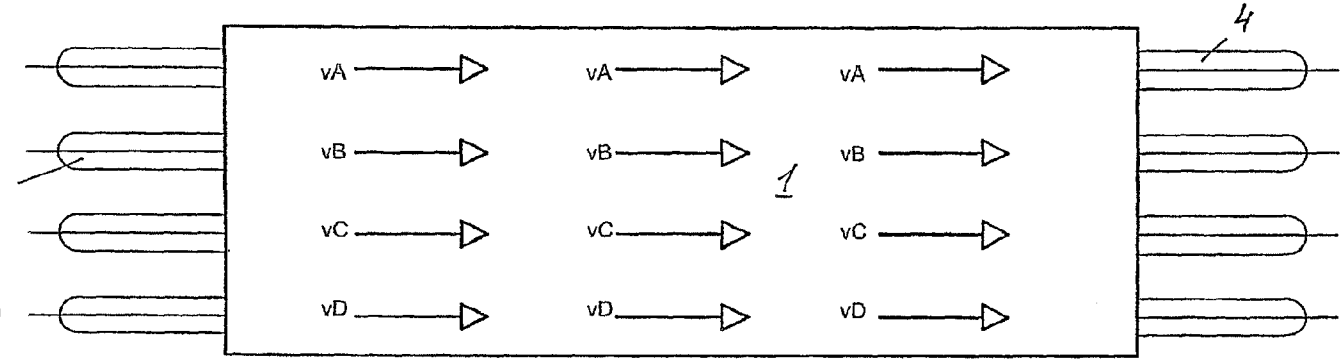
FIG. 13 again shows the flow conditions in a plan view.

In the exemplary embodiment according to FIGS. 12 and 13, a treadmill 20, on which the training person 19 runs, is placed in flow channel 1. To this end, as shown in FIG. 12, circulation lines 2, 3 are active in the two zones near the bottom (i.e., vα and vβ are greater than 0), as a result of which within the flow channel in the area of the legs a flow velocity v2 and v3 becomes established, which is the same among themselves and overall greater than 0. There is no flow in the area of the upper body, i.e., v1 is equal to 0 and the delivery device in circulation line 3 is not active. In the horizontal extent of flow channel 1, again all velocities are set uniform, so that a laminar flow is achieved over the entire width of the flow channel.

Figure 14:
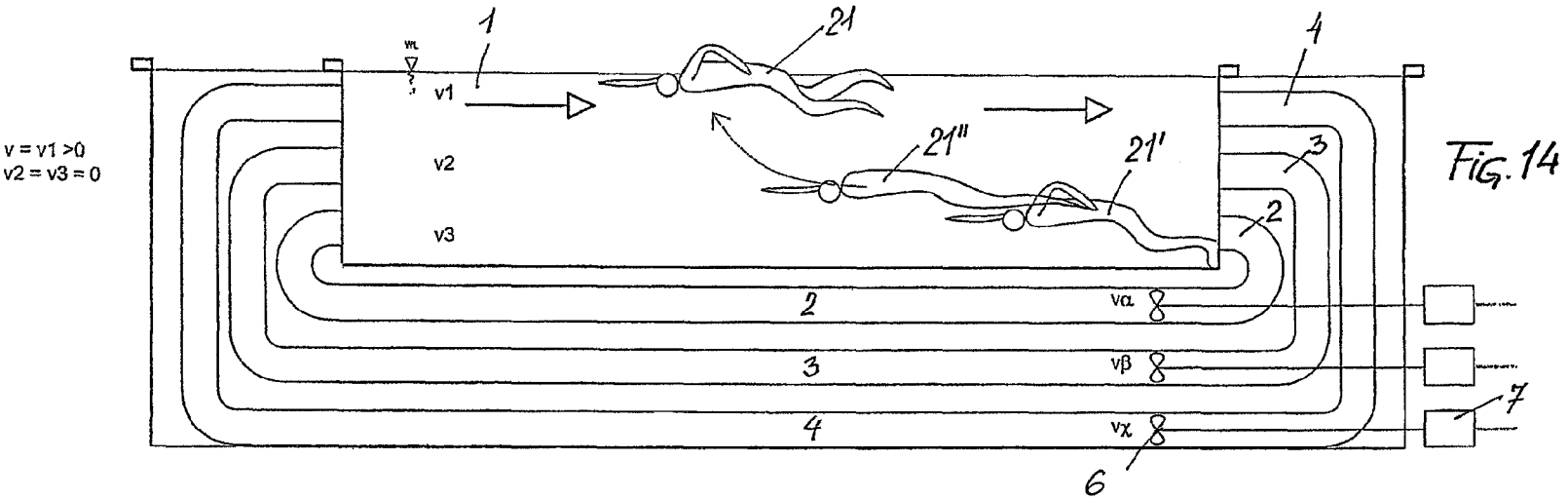
FIG. 14 shows a longitudinal cross section with a swimmer in the pool, whereby the delivery devices are active only in the topmost zone.
Figure 15:
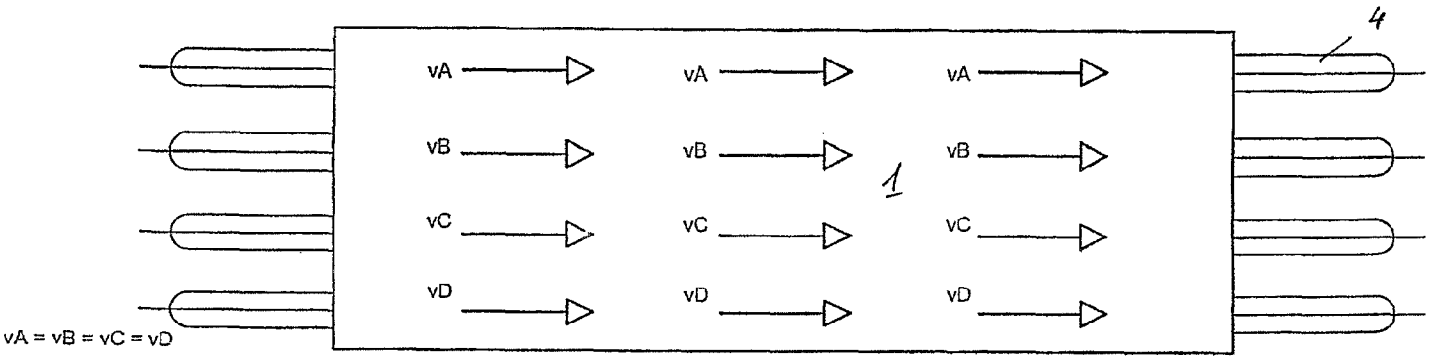
FIG. 15 shows a plan view with indicated flow pattern.

In FIGS. 14 and 15, the conditions for a swimmer 21 are shown, who runs through his training tasks in the flow channel. In this case, the velocity v1 is greater than 0 only in the surface area and the delivery devices of circulation lines 2 and 3 are not active in areas v2 and v3, so that the flow velocity vα and vβ is zero in the circulation, line and accordingly in this area the swimmer need not overcome any flow. A laminar flow is again achieved across the horizontal extent of the flow channel.

The circumstance that an artificial flow is generated only in the surface area has the result that if the flow velocity v1 is too high, the swimmer has the option of letting himself sink to the bottom, whereby he can then push off the end wall 24 (21') and immersed without a countercurrent in 21" can again emerge in the flow area.

It can be stated in summary that the flow channel of the invention can be used with great versatility and can be regulated adapted to specific requirements.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A flow channel, in which water is caused to flow via a controllable delivery device disposed in each of at least two circulation lines, each of the at least two circulation lines having an intake opening and an outlet opening, wherein the outlet openings are positioned such that the at least two circulation lines discharge separated from one another into the flow channel, wherein the outlet openings of the at least two circulation lines are distributed over an end wall of the flow channel, and wherein the outlet opening of a first one of the at least two circulation lines is arranged at a respective height, from a bottom surface of the flow channel, that differs from a respective height of the outlet opening of a second one of the at least two circulation lines.

2. The flow channel according to claim 1, wherein the at least two circulation lines are divided into zones, whose delivery devices are controlled differently.

3. The flow channel according to claim 2, wherein in the zones, adjacent to the side walls and/or a bottom of the flow channel, the delivery devices are regulated to a higher flow velocity.

4. The flow channel according to claim 1, wherein the intake openings of the at least two circulation lines are disposed in the opposite end wall as the outlet openings and at the same height as the outlet openings.

5. The flow channel according to claim 1, wherein the intake openings of all of the at least two circulation lines are disposed in the bottom area of the end of the flow channel, said end lying opposite to the end containing the outlet openings.

6. The flow channel according to claim 1, wherein the delivery devices of all of the at least two circulation lines are regulated depending on the flow resistance in the associated circulation line.

7. The flow channel according to claim 2, wherein the delivery devices are controlled via a common control unit.

8. The flow channel according to claim 7, wherein the control unit is connectable to sensors and/or measuring devices extending into the flow, whose measurement results are the control variables for the control unit.

9. The flow channel according to claim 1, wherein a tube de-aerating device is provided at each of the at least two circulation lines downstream of the delivery device.

10. The flow channel according to claim 2, wherein the zones are provided at differing heights within the flow channel.

11. The flow channel according to claim 7, further comprising flow measuring transducers provided in a wall of the flow channel, wherein measurement results of the flow measuring transducers form control variables for the common control unit.

12. The flow channel according to claim 7, further comprising at least one flow meter in each of the at least two circulation lines, wherein measurement results of the flow meters form control variables for the common control unit.

13. A flow channel system, comprising:

a flow channel; and at least two rows of circulation lines, wherein:

each circulation line of the at least two rows of circulation lines has a controllable delivery device disposed therein, in which water is caused to flow, each circulation line of the at least two rows of circulation lines has an intake opening and an outlet opening, the outlet openings within a first row of the at least two rows of circulation lines are all arranged at a same first height from a bottom surface of the flow channel, and, the outlet openings within a second row of the at least two rows of circulation lines are all arranged at a same second height from the bottom surface of the flow channel, and the first height of the outlet openings of the first row of circulation lines differs from the second height of the outlet openings of the second row of circulation lines.

14. The flow channel system according to claim 13, wherein the outlet openings of the second row of circulation lines are positioned directly below the outlet openings of the first row of circulation lines.

* * * * *